US009767826B2

(12) United States Patent
Matheja et al.

(10) Patent No.: US 9,767,826 B2
(45) Date of Patent: Sep. 19, 2017

(54) METHODS AND APPARATUS FOR ROBUST SPEAKER ACTIVITY DETECTION

(71) Applicant: NUANCE COMMUNICATIONS, INC., Burlington, MA (US)

(72) Inventors: Timo Matheja, Ulm (DE); Tobias Herbig, Ulm (DE); Markus Buck, Biberach (DE)

(73) Assignee: NUANCE COMMUNICATIONS, INC., Burlington, MA (US)

( * ) Notice: Subject to any disclaimer, the term of this patent is extended or adjusted under 35 U.S.C. 154(b) by 0 days.

(21) Appl. No.: 15/024,543

(22) PCT Filed: Sep. 27, 2013

(86) PCT No.: PCT/US2013/062244

§ 371 (c)(1),
(2) Date: Mar. 24, 2016

(87) PCT Pub. No.: WO2015/047308

PCT Pub. Date: Apr. 2, 2015

(65) Prior Publication Data

US 2016/0232920 A1 Aug. 11, 2016

(51) Int. Cl.
*H04R 3/00* (2006.01)
*G10L 25/21* (2013.01)
(Continued)

(52) U.S. Cl.
CPC ..... *G10L 25/21* (2013.01); *G10L 21/0208* (2013.01); *G10L 25/78* (2013.01); *H04R 3/005* (2013.01); *G10L 2021/02087* (2013.01); *G10L 2021/02166* (2013.01); *H04R 2430/03* (2013.01); *H04R 2499/13* (2013.01)

(58) Field of Classification Search
CPC ..... H10L 25/21; H10L 21/0208; G10L 25/21; G10L 21/0208; G10L 25/78; H04R 3/005
See application file for complete search history.

(56) References Cited

U.S. PATENT DOCUMENTS

2003/0069727 A1 4/2003 Krasny et al.
2004/0042626 A1* 3/2004 Balan ..... G10L 25/78 381/110

(Continued)

FOREIGN PATENT DOCUMENTS

JP 2006 109275 A 4/2006
JP 2009-188442 A 8/2009

OTHER PUBLICATIONS

PCT International Preliminary Report dated Mar. 29, 2016 corresponding to International Application No. PCT/US2013/062244; 6 Pages.

(Continued)

*Primary Examiner* — Simon King
(74) *Attorney, Agent, or Firm* — Daly, Crowley Mofford & Durkee, LLP

(57) ABSTRACT

Method and apparatus to determine a speaker activity detection measure from energy-based characteristics of signals from a plurality of speaker-dedicated microphones, detect acoustic events using power spectra for the microphone signals, and determine a robust speaker activity detection measure from the speaker activity measure and the detected acoustic events.

17 Claims, 5 Drawing Sheets

(51) Int. Cl.

| | |
|---|---|
| ***G10L 25/78*** | (2013.01) |
| ***G10L 21/0208*** | (2013.01) |
| *G10L 21/0216* | (2013.01) |

(56) References Cited

U.S. PATENT DOCUMENTS

| | | | | |
|---|---|---|---|---|
| 2005/0058278 | A1 | 3/2005 | Gallego Hugas et al. | |
| 2007/0021958 | A1* | 1/2007 | Visser | G10L 21/0272 704/226 |
| 2009/0164212 | A1* | 6/2009 | Chan | G10L 21/0208 704/226 |
| 2010/0280824 | A1* | 11/2010 | Petit | G10L 21/0208 704/214 |
| 2012/0221341 | A1* | 8/2012 | Rodemer | G10L 21/0264 704/275 |
| 2012/0290297 | A1 | 11/2012 | Baughman et al. | |

OTHER PUBLICATIONS

Matheja et al.; "Enhanced Speaker Activity Detection for Distributed Microphones By Exploitation of Signal Power Ratio Patterns"; Nuance Communications Aachen GmbH, Ulm, Germany, Mar. 27, 2012, 4 pages.

Matheja et al.; "Dynamic Signal Combining for Distributed Microphone Systems in Car Environments"; Nuance Communications Aachen GmbH, Ulm, Germany, May 22, 2011, 4 pages.

Matheja et al.; "Robust Voice Activity Detection for Distributed Microphones by Modeling of Power Ratios"; Nuance Communications Aachen GmbH, Ulm, Germany, Oct. 8, 2010, 4 pages.

Notification of Transmittal of the International Search Report and the Written Opinion of the International Searching Authority, or the Declaration, PCT/US2013/062244, date of mailing Jun. 26, 2014, 3 pages.

Written Opinion of the International Searching Authority, PCT/US2013/062244, date of mailing Jun. 26, 2014, 5 pages.

* cited by examiner

METHODS AND APPARATUS FOR ROBUST SPEAKER ACTIVITY DETECTION

CROSS REFERENCE TO RELATED APPLICATIONS

This application is a National Stage application of PCT/US2013/062244 filed on Sep. 27, 2013, published in the English language on Apr. 2, 2015 as International Publication Number WO 2015/047308 A1, entitled "Methods and Apparatus for Robust Speaker Activity Detection", which is incorporated herein by reference.

BACKGROUND

In digital signal processing, many multi-microphone arrangements exist where two or more microphone signals have to be combined. Applications may vary, for example, from live mixing scenarios associated with teleconferencing to hands-free telephony in a car environment. The signal quality may differ among the various speaker channels depending on the microphone position, the microphone type, the kind of background noise and the speaker. For example, consider a hands-free telephony system that includes multiple speakers in a car. Each speaker has a dedicated microphone capable of capturing speech. Due to different influencing factors like an open window, background noise can vary strongly if the microphone signals are compared among each other.

SUMMARY

In speech communication systems in various environments, such as automotive passenger compartments, there is increasing interest in hands-free telephony and speech dialog systems. Distributed and speaker-dedicated microphones mounted close to each passenger in the car, for example, enable all speakers to participate in hands-free conference phone calls at the same time. To control the necessary speech signal processing, such as adaptive filter and signal combining within distributed microphone setups, it should be known which speaker is speaking at which time instance, such as to activate a speech dialog system by an utterance of a specific speaker.

Due to the arrangement of microphones close to the particular speakers, it is possible to exploit the different and characteristic signal power ratios occurring between the available microphone channel signals. Based on this information, an energy-based speaker activity detection (SAD) can be performed.

In general, vehicles can include distributed seat-dedicated microphone systems. In exemplary embodiments of the invention, a system addresses speaker activity detection and the selection of the optimal microphone in a system with speaker-dedicated microphones. In one embodiment, there is either one microphone per speaker or a group of microphones per speaker. Multiple microphones can be provided in each seat belt and loudspeakers can be provided in a head-rest for convertible vehicles. The detection of channel-related acoustic interfering events provides robustness of speaker activity detection and microphone selection.

Channel-specific acoustic events include wind buffets, and scratch or contact noises, for example, which events should be distinguished from speaker activity. On the one hand, the system should react quickly when distortions are detected on the currently selected sensor used for further speech signal processing. A setup with a group of microphones for each seat is advantageous because the next best and not distorted microphone in the group can be selected. On the other hand, microphone selection should not be influenced if microphones which are currently inactive get distorted. If not avoided, the system would switch from a microphone with good signal quality to a distorted microphone signal. In other words, speaker activity detection and microphone selection are controlled by robust event detection.

Exemplary embodiments of the invention, by applying appropriate event detectors, reduce speaker activity misdetection rates during interfering acoustic events as compared to known systems. If one microphone is detected to be distorted, the detection of speech activity is avoided and, depending on the further processing, a different microphone can be selected.

Exemplary embodiments of the invention provide robust speaker activity detection by distinguishing between the activity of a desired speaker and local distortion events at the microphones (e.g., caused by wind noise or by touching the microphone). The robust joint speaker activity and event detection is beneficial for the control of further speech signal enhancement and can provide useful information for the speech recognition process. In some embodiments, the performance of further speech enhancement in double-talk situations (where several passengers speak at the same time) is increased as compared with known systems. For systems with multiple distributed microphones for each seat (e.g. on the seat belt), exemplary embodiments of the invention allow for a robust detection of the group of microphones that best captures the active speaker, followed by a selection of the optimal microphone. Thus, only one microphone per speaker has to be further processed for speech enhancement to reduce the amount of required processing.

In one aspect of the invention, a method comprises: receiving signals from speaker-dedicated first and second microphones; computing, using a computer processor, an energy-based characteristic of the signals for the first and second microphones; determining a speaker activity detection measure from the energy-based characteristics of the signals for the first and second microphones; detecting acoustic events using power spectra for the signals from the first and second microphones; and determining a robust speaker activity detection measure from the speaker activity measure and the detected acoustic events.

The method can further include one or more of the following features: the signals from the speaker-dedicated first microphone include signals from a plurality of microphones for a first speaker, the energy-based characteristics include one or more of power ratio, log power ratio, comparison of powers, and adjusting powers with coupling factors prior to comparison, providing the robust speaker activity detection measure to a speech enhancement module, using the robust speaker activity measure to control microphone selection, using only the selected microphone in signal speech enhancement, using SNR of the signals for the microphone selection, using the robust speaker activity detection measure to control a signal mixer, the acoustic events include one or more of local noise, wind noise, diffuse sound, double-talk, the acoustic events include double talk determined using a smoothed measure of speaker activity that is thresholded, excluding use of a signal from a first microphone based on detection of an event local to the first microphone, selecting a first signal of the signals from the first and second microphones based on SNR, receiving the signal from at least one microphone on a seat belt of a vehicle, performing a microphone signal pair-wise comparison of power or spectra, and/or computing the energy-based characteristic of the signals for the first and second microphones by: determining a speech signal power spectral density (PSD) for a plurality of microphone channels; determining a logarithmic signal to power ratio (SPR) from the determined PSD for the plurality of microphones; adjusting the logarithmic SPR for the plurality of microphones by using a first threshold; determining a signal to noise ratio (SNR) for the plurality of microphone channels; counting a number of times per sample quantity the adjusted logarithmic SPR is above and below a second threshold; determining speaker activity detection (SAD) values for the plurality of microphone channels weighted by the SNR; and comparing the SAD values against a third threshold to select a first one of the plurality of microphone channels for the speaker.

In another aspect of the invention, a system comprises: a speaker activity detection module; an acoustic event detection module coupled to the speaker activity module; a robust speaker activity detection module; and a speech enhancement module. The system can further include a SNR module and a channel selection module coupled to the SNR module, the robust speaker identification module, and the event detection module.

In a further aspect of the invention, an article comprises: a non-transitory computer readable medium having stored instructions that enable a machine to: receive signals from speaker-dedicated first and second microphones; compute an energy-based characteristic of the signals for the first and second microphones; determine a speaker activity detection measure from the energy-based characteristics of the signals for the first and second microphones; detect acoustic events using power spectra for the signals from the first and second microphones; and determine a robust speaker activity detection measure from the speaker activity measure and the detected acoustic events.

BRIEF DESCRIPTION OF THE DRAWINGS

The foregoing features of this invention, as well as the invention itself, may be more fully understood from the following description of the drawings in which.

DETAILED DESCRIPTION

Figure 1:
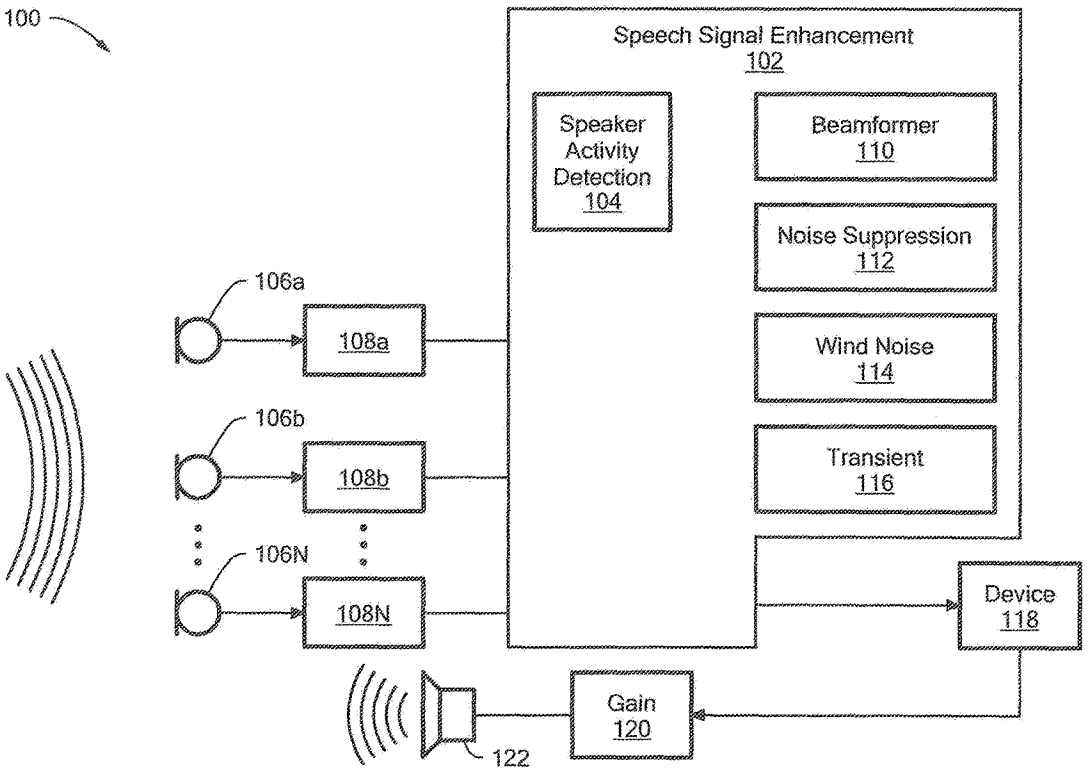
FIG. 1 is a schematic representation of an exemplary speech signal enhancement system having robust speaker activity detection in accordance with exemplary embodiments of the invention.

FIG. 1 shows an exemplary communication system 100 including a speech signal enhancement system 102 having a speaker activity detection (SAD) module 104 in accordance with exemplary embodiments of the invention. A microphone array 106 includes one or more microphones 106*a*-N receives sound information, such as speech from a human speaker. It is understood that any practical number of microphones 106 can be used to form a microphone array.

Respective pre-processing modules 108*a*-N can process information from the microphones 106*a*-N. Exemplary pre-processing modules 108 can include echo cancellation.

Additional signal processing modules can include beamforming 110, noise suppression 112, wind noise suppression 114, transient removal 116, etc.

The speech signal enhancement module 102 provides a processed signal to a user device 118, such as a mobile telephone. A gain module 120 can receive an output from the device 118 to amplify the signal for a loudspeaker 122 or other sound transducer.

Figure 2:
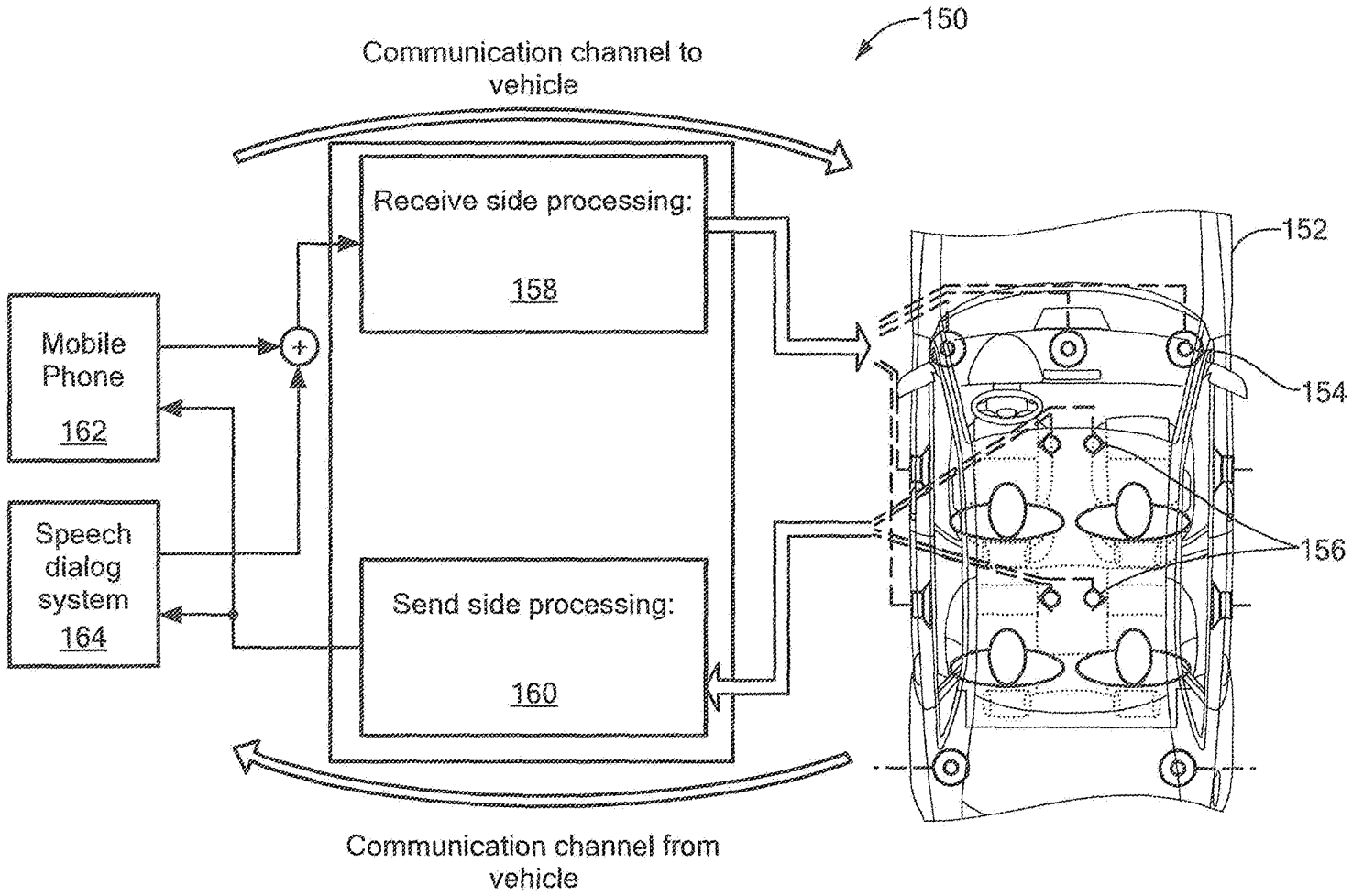
FIG. 2 is a schematic representation of a vehicle having speaker dedicated microphones for a speech signal enhancement system having robust speaker activity detection.

FIG. 2 shows an exemplary speech signal enhancement system 150 for an automotive application. A vehicle 152 includes a series of loudspeakers 154 and microphones 156 within the passenger compartment. In one embodiment, the passenger compartment includes a microphone 156 for each passenger. In another embodiment (not shown), each passenger has a microphone array.

The system 150 can include a receive side processing module 158, which can include gain control, equalization, limiting, etc., and a send side processing module 160, which can include speech activity detection, such as the speech activity detection module 104 of FIG. 1, echo suppression, gain control, etc. It is understood that the terms receive side and send side are relative to the illustrated embodiment and should not be construed as limiting in any way. A mobile device 162 can be coupled to the speech signal enhancement system 150 along with an optional speech dialog system 164.

In an exemplary embodiment, a speech signal enhancement system is directed to environments in which each person in the vehicle has only one dedicated microphone as well as vehicles in which a group of microphones is dedicated to each seat to be supported in the car. After robust speaker activity and event detection by the system, the best microphone can be selected for a speaker out of the available microphone signals.

In general, a speech signal enhancement system can include various modules for speaker activity detection based on the evaluation of signal power ratios between the microphones, detection of local distortions, detection of wind noise distortions, detection of double-talk periods, indication of diffuse sound events, and/or joint speaker activity detection. As described more fully below, for preliminary broadband speaker activity detection the signal power ratio between the signal power in the currently considered microphone channel and the maximum of the remaining channel signal powers is determined. The result is evaluated in order to distinguish between different active speakers. Based on this it is determined across all frequency subbands for each time frame how often the speaker-dedicated microphone shows the maximum power (positive logarithmic signal power ratio) and how often one of the other microphone signals shows the largest power (negative logarithmic signal power ratio). Subsequently, an appropriate signal-to-noise ratio weighted measure is derived that shows higher positive values for the indication of the activity of one speaker. By applying a threshold the basic broadband speaker activity detection is determined.

Local distortions in general, e.g., touching a microphone or local body-borne noise, can be detected by evaluating the spectral flatness of the computed signal power ratios. If local distortions are predominant in the microphone signal, the signal power ratio spectrum is flat and shows high values across the whole frequency range. The well-known spectral flatness, for example, is comp[illegible] by the ratio between the geometric and the arithmetic mean of the signal power ratios across all frequencies.

Similar to the detection of local distortions, wind noise in one microphone can be detected by evaluating the spectral flatness of the signal power ratio spectrum. Since wind noises arise mainly below 2000 Hz, a first spectral flatness is computed for lower frequencies up to 2000 Hz. Wind noise is a kind of local distortion and causes a flat signal power spectrum in the low frequency region. Wind noise in one microphone channel is detected if the spectral flatness in the low frequency region is high and the second spectral flatness measure referring to all subbands and already used for the detection of local distortion in general is low.

Double-talk is detected if more than one signal power ratio measure shows relatively high positive values indicating possible speaker activity of the related speakers. Based on this continuous regions of double-talk can be detected.

Diffuse sound events generated by active speakers who are not close to one microphone or a specific group of microphones can be indicated if the most signal power ratio measures show positive, but relatively low, values, in contrast to double-talk scenarios.

In general, the preliminary broadband speaker activity detection is combined with the result of the event detectors reflecting local distortions and wind noise to enhance the robustness of speaker activity detection. Depending on the application, double-talk detection and the indication of diffuse sound sources can also be included.

In another aspect of the invention, a speech signal enhancement system uses the above speaker activity and event detection for a microphone selection process. In exemplary embodiments of the invention, microphone selection is used for environments having one single seat-dedicated microphone for each seating position and speaker-dedicated groups of microphones.

For single seat-dedicated microphones, if one speaker-dedicated microphone is corrupted by any local distortion (detected by the event detection), the signal of one of the other distant microphone signals showing the best signal-to-noise ratio can be selected. For seat-dedicated microphone groups, if the microphone setup in the car is symmetric for the driver and front-passenger, it is possible to apply processing to pairs of microphones (corresponding microphones on driver and passenger side). The decision on the best microphone for one speaker is only allowed when the joint speaker activity and event detector have detected single-talk for the relevant speaker and no distortions. If these conditions are met, the channel with the best SNR or the best signal quality is selecte[illegible]

FIG. 2 shows an exemplary speaker activity detection module 200 in accordance with exemplary embodiments of the invention. In exemplary embodiments, an energy-based speaker activity detection (SAD) system evaluates a signal power ratio (SPR) in each of M≥2 microphone channels. In embodiments, the processing is performed in the discrete Fourier transform domain with the frame index l and the frequency subband index k at a sampling rate of $f_s$=16 kHz, for example. In one particular embodiment, the time domain signal is segmented by a Hann window with a frame length of K=512 samples and a frame shift of 25%. It is understood that basic fullband SAD is the focus here and that enhanced fullband SAD and frequency selective SAD are not discussed herein, Using the microphone signal spectra Y(l,k), the power ratio (l,k) and the signal-to-noise ratio (SNR) $\hat{\xi}_m(l,k)$ are computed to determine a basic fullband speaker activity detection (l). As described more fully below, in one embodiment different speakers can be distinguished by analyzing how many positive and negative values occur for the logarithmic SPR in each frame for each channel m, for example.

Before considering the SAD, the system should determine SPRs. Assuming that speech and noise components are uncorrelated and that the microphone signal spectra are a superposition of speech and noise components, the speech signal power spectral density (PSD) estimate $\hat{\Phi}_{\Sigma\Sigma,m}(l,k)$ in channel in can be determined by $$\hat{\Phi}_{\Sigma\Sigma,m}(l,k)=\max\{\hat{\Phi}_{YY,m}(l,k)-\hat{\Phi}_{NN,m}(l,k),0\}, \tag{1}$$

where $\hat{\Phi}_{YY,m}(l,k)$ may be estimated by temporal smoothing of the squared magnitude of the microphone signal spectra $Y_m(l,k)$. The noise PSD estimate $\hat{\Phi}_{NN,m}(l,k)$ can be determined by any suitable approach such as an improved minimum controlled recursive averaging approach described in I. Cohen, "Noise Spectrum Estimation in Adverse Environments: Improved Minima Controlled Recursive Averaging," *IEEE Transactions on Speech and Audio Processing*, vol. 11, no. 5, pp. 466-475, September 2003, which is incorporated herein by reference. Note that within the measure in Equation (1), direct speech components originating from the speaker related to the considered microphone are included, as well as cross-talk components from other sources and speakers. The SPR in each channel m can be expressed below for a system with M≥2 microphones as $$\widetilde{SPR}_m(\ell,k)=\frac{\max\{\hat{\Phi}_{SS,m}(\ell,k),\epsilon\}}{\max\left\{\max\limits_{\substack{m'\in\{1\ldots M\}\\ m'\neq m}}\{\hat{\Phi}_{SS,m'}(\ell,k)\},\epsilon\right\}} \tag{2}$$

with the small value ϵ, as discussed similarly in T. Matheja, M. Buck, T. Wolff, "Enhanced Speaker Activity Detection for Distributed Microphones by Exploitation of Signal Power Ratio Patterns," in *Proc. IEEE International Conference on Acoustics, Speech, and Signal Processing* (*ICASSP*), pp. 2501-2504, Kyoto, Japan, March 2012, which is incorporated herein by reference.

It is assumed that one microphone always captures the speech best because each speaker has a dedicated microphone close to the speaker's position. Thus, the active speaker can be identified by evaluating the SPR values among the available microphones. Furthermore, the logarithmic SPR quantity enhances differences for lower values and results in $$S\quad'_m(l,k)=10\log_{10}(S\quad_m(l,k)) \tag{3}$$

Speech activity in the in-th speaker related microphone channel can be detected by evaluating if the occurring logarithmic SPR is larger than 0 dB, in one embodiment. To avoid considering the SPR during periods where the SNR $\xi_m(l,k)$ shows only small values lower than a threshold $\Theta_{SNR1}$, a modified quantity for the logarithmic power ratio in Equation (3) is defined by $$\widetilde{SPR}_m(\ell,k)=\begin{cases}\hat{SPR}'_m(\ell,k), & \text{if } \hat{\xi}_m(\ell,k)\geq\Theta_{SNR},\\ 0, & \text{else}\end{cases}. \tag{4}$$

With a noise estimate $\hat{\phi}_{NN,m}$ (l,k) for determination of a reliable SNR quantity, the SNR is determined in a suitable manner as in Equation (5) below, such as that disclosed by R. Martin, "An Efficient Algorithm to Estimate the Instantaneous SNR of Speech Signals," in *Proc. European Conference on Speech Communication and Technology* (*EUROSPEECH*), Berlin, Germany, pp. 1093-1096, September 1993.

$$\hat{\xi}_m(\ell, k) = \frac{\min\{\hat{\Phi}_{YY,m}(\ell, k), |Y_m(\ell, k)|^2\}\hat{\Phi}'_{NN,m}(\ell, k)}{\hat{\Phi}'_{NN,m}(\ell, k)}. \tag{5}$$

Using the overestimation factor $\gamma_{SNR}$ the considered noise PSD results in $$\hat{\Phi}'_{NN,m}(l,k)=\gamma_{SNR}\cdot\hat{\Phi}_{NN,m}(l,k). \tag{6}$$

Based on Equation (4), the power ratios are evaluated by observing how many positive (+) or negative (−) values occur in each frame. Hence, for the positive counter follows:

$$c_m^+(\ell) = \sum_{k=0}^{K/2} c_m^+(\ell, k). \tag{7}$$

with $$c_m^+(\ell, k) = \begin{cases} 1, & \text{if } \widetilde{\widetilde{SPR}}_m(\ell, k) < 0, \\ 0, & \text{else} \end{cases}. \tag{8}$$

Equivalently the negative counter can be determined by $$c_m^-(\ell) = \sum_{k=0}^{K/2} c_m^-(\ell, k), \tag{9}$$

considering $$c_m^-(\ell, k) = \begin{cases} 1, & \text{if } \widetilde{\widetilde{SPR}}_m(\ell, k) < 0, \\ 0, & \text{else.} \end{cases} \tag{10}$$

Regarding these quantities, a soft frame-based SAD measure may be written by $$X_m^{SAD}(\ell) = G_m^c(\ell) \cdot \frac{c_m^+(\ell) - c_m^-(\ell)}{c_m^+(\ell) + c_m^-(\ell)}, \tag{11}$$

where $G_m^c(l)$ is an SNR-dependent soft weighting function to pay more attention to high SNR periods. In order to consider the SNR within certain frequency regions the weighting function is computed by applying maximum subgroup SNRs:

$$G_m^c(l)=\min\{\hat{\xi}_{max,m}^G(l)/10,1\}. \tag{12}$$

The maximum SNR across K' different frequency subgroup SNRs $\hat{\xi}_m^G(l,æ)$ is given by $$\hat{\xi}_{max,m}^G(\ell) = \max_{æ\in\{1,\ldots,K'\}} \{\hat{\xi}_m^G(\ell, æ)\}. \tag{13}$$

The grouped SNR values can each be computed in the range between certain DFT bins $k_{æ}$ and $k_{æ+1}$ with æ=1, 2, . . . , K' and $\{k_{æ}\}$={4, 28, 53, 78, 103, 128, 153, 178, 203, 228, 253}. We write for the mean SNR in the æ-th subgroup:

$$\hat{\xi}_m^G(\ell, æ) = \frac{1}{k_{æ+1} - k_{æ}} \sum_{k=k_{æ}+1}^{k_{æ+1}} \hat{\xi}_m(\ell, k) \tag{14}$$

The basic fullband SAD is obtained by thresholding using $\Theta_{SAD1}$:

$$\tilde{SAD}_m(\ell) = \begin{cases} 1, & \text{if } X_m^{SAD}(\ell) > \Theta_{SAD1}, \\ 0, & \text{else.} \end{cases} \tag{15}$$

It is understood that during double-talk situations the evaluation of the signal power ratios is no longer reliable. Thus, regions of double-talk should be detected in order to reduce speaker activity misdetections. Considering the positive and negative counters, for example, a double-talk measure can be determined by evaluating whether $c_m^+(l)$ exceeds a limit $\Theta_{DTM}$ during periods of detected fullband speech activity in multiple channels.

To detect regions of double-talk this result is held for some frames in each channel. In general, double-talk (l)=1 is detected if the measure is true for more than one channel. Preferred parameter settings for the realization of the basic fullband SAD can be found in Table 1 below.

TABLE 1

Parameter settings for exemplary implementation of the basic fullband SAD algorithm (for M = 4)

| | | |
|---|---|---|
| $\Theta_{SNR1}$ = 0.25 | $\gamma_{SNR}$ = 4 | K' = 10 |
| $\Theta_{SAD1}$ = 0.0025 | $\Theta_{DTM}$ = 30 | |

Figure 3:
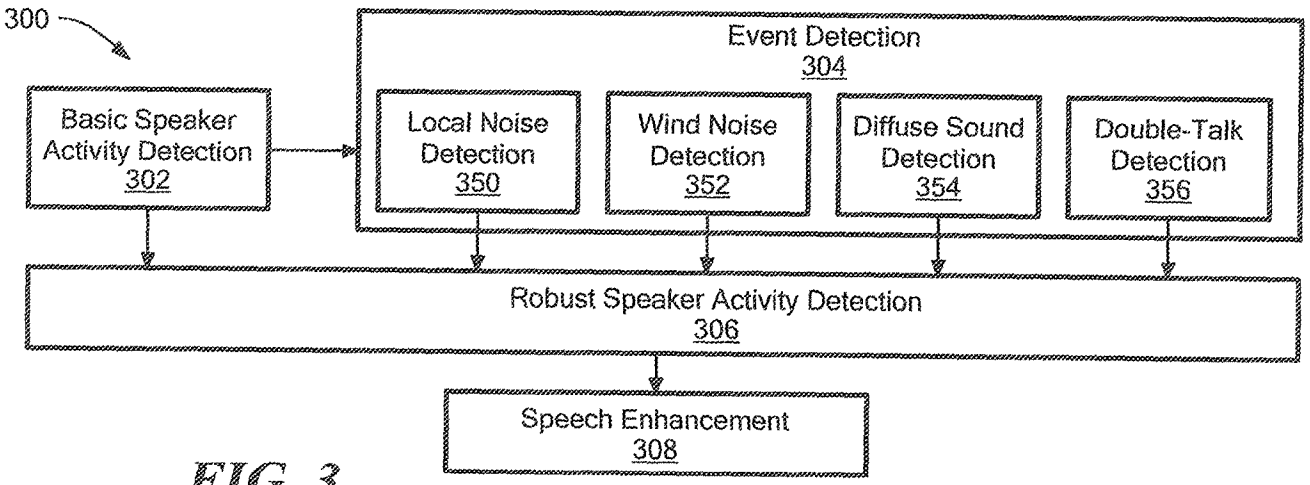
FIG. 3 is a schematic representation of an exemplary robust speaker activity detection system.

FIG. 3 shows an exemplary speech signal enhancement system 300 having a speaker activity detection (SAD) module 302 and an event detection module 304 coupled to a robust speaker detection module 306 that provides information to a speech enhancement module 308. In one embodiment, the event detection module 304 includes at least one of a local noise detection module 350, a wind noise detection module 352, a diffuse sound detection module 354, and a double-talk detection module 356.

The basic speaker activity detection (SAD) module 302 output is combined with outputs from one or more of the event detection modules 350, 352, 354, 356 to avoid a possible positive SAD result during interfering sound events. A robust SAD result can be used for further speech enhancement 308.

It is understood that the term robust SAD refers to a preliminary SAD evaluated against at least one event type so that the event does not result in a false SAD indication, wherein the event types include one or more of local noise, wind noise, diffuse sound, and/or double-talk.

In one embodiment, the local noise detection module 350 detects local distortions by evaluation of the spectral flatness of the difference between signal powers across the microphones, such as based on the signal power ratio. The spectral flatness measure in channel m for $\tilde{K}$ subbands, can be provided as:

$$X_{m,\tilde{K}}^{SF}(\ell) = \frac{\exp\left\{\frac{1}{\tilde{K}} \cdot \sum_{k=0}^{\tilde{K}-1} \log(\max\{\widetilde{SPR}_m(\ell, k), \epsilon\})\right\}}{\frac{1}{\tilde{K}} \cdot \sum_{k=0}^{\tilde{K}-1} \max\{\widetilde{SPR}_m(\ell, k), \epsilon\}} \tag{16}$$

Temporal smoothing of the spectral flatness with γSF can be SÃDvided during speaker activity ( $_m$(l)>0) and decreasing with $\gamma_{dec}^{SF}$ when there is not speaker activity as set forth below:

$$\overline{X}_{m,\tilde{K}}^{SF}(\ell) = \begin{cases} \gamma_{SF} \cdot \overline{X}_{m,\tilde{K}}^{SF}(\ell-1) + (1-\gamma_{SF}) \cdot X_{m,\tilde{K}}^{SF}(\ell), & \text{if } \widetilde{SAD}_m(\ell) > 0, \\ \gamma_{dec}^{SF} \cdot \overline{X}_{m,\tilde{K}}^{SF}(\ell-1), & \text{else.} \end{cases} \tag{17}$$

In one embodiment, the smoothed spectral flatness can be thresholded to determine whether local noise is detected. Local Noise Detection (LND) in channel m with $\tilde{K}$: whole frequency range and threshold $\Theta_{LND}$ can be expressed as follows:

$$LND_m(\ell) = \begin{cases} 1, & \text{if } \overline{X}_{m,\tilde{K}}^{SF}(\ell) > \Theta_{LND}, \\ 0, & \text{else.} \end{cases} \tag{18}$$

In one embodiment, the wind noise detection module 350 thresholds the smoothed spectral flatness using a selected maximum frequency for wind. Wind noise detection (WND) in channel m with $\tilde{K}$ being the number of subbands up to, e.g., 2000 Hz and the threshold $\Theta_{WND}$ can be expressed as:

$$WND_m(\ell) = \begin{cases} 1, & \text{if } \left(\overline{X}_{m,\tilde{K}}^{SF}(\ell) > \Theta_{WND}\right) \wedge (LND_m(\ell) < 1), \\ 0, & \text{else.} \end{cases} \tag{19}$$

It is understood that the maximum frequency, number of subbands, smoothing parameters, etc., can be varied to meet the needs of a particular application. It is further understood that other suitable wind detection techniques known to one of ordinary skill in the art can be used to detect wind noise.

In an exemplary embodiment, the diffuse sound detection module 354 indicates regions where diffuse sound sources may be active that might harm the speaker activity detection. Diffuse sounds are detected if the power across the microphones is similar. The diffuse sound detection module is based on the speaker activity detection measure $\chi_m^{SAD}$(l) (see Equation (11)). To detect diffuse events a certain positive threshold has to be exceeded by this measure in all of the available channels, whereas $\chi_m^{SAD}$(l) has to be always lower than a second higher threshold.

In one embodiment, the double-talk module 356 estimates the maximum speaker activity detection measure based on the speaker activity detection measure $\chi_m^{SAD}$(l) set forth in Equation (11) above, with an increasing constant $\gamma_{inc}^{\chi}$ applied during fullband speaker activity if the current maximum is smaller than the currently observed SAD measure. The decreasing constant $\gamma_{dec}^{\chi}$ is applied otherwise, as set forth below.

$$\hat{X}_{max,m}^{SAD}(\ell) = \begin{cases} \hat{\lambda}_{max,m}^{SAD}(\ell-1) + \lambda_{inc}^{X}, & \text{if } \left(\hat{X}_{max,m}^{SAD}(\ell-1) < X_m^{SAD}(\ell)\right) \wedge (\widetilde{SAD}_m(\ell) > 0), \\ \max\{\hat{X}_{max,m}^{SAD}(\ell-1) - \gamma_{dec}^{X}, -1\}, & \text{else.} \end{cases} \tag{20}$$

Temporal smoothing of the speaker activity measure maximum can be provided with $\gamma_{SAD}$ as follows:

$$\overline{\chi}_{max,m}^{SAD}(l) = \gamma_{SAD} \cdot \overline{\chi}_{max,m}^{SAD}(l-1) + (1-\gamma_{SAD}) \cdot \hat{\chi}_{max,m}^{SAD}(l). \tag{21}$$

Double talk detection (DTD) is indicated if more than one channel shows a smoothed maximum measure of speaker activity larger than a threshold $\Theta_{DTD}$, as follows:

$$DTD(\ell) = \begin{cases} 1, & \left(\left(\sum_{m=1}^{M} f\left(\overline{X}_{max,m}^{SAD}(\ell), \Theta_{DTD}\right)\right) > 1\right), \\ 0, & \text{else.} \end{cases} \tag{22}$$

Here the function $f$(x,y) performs threshold decision:

$$f(x, y) = \begin{cases} 1, & \text{if } x > y, \\ 0, & \text{else.} \end{cases} \tag{23}$$

With the constant γDTD∈{0, . . . , 1} we get a measure for detection of double-talk regions modified by an evaluation of whether double-talk has been detected for one frame:

$$\overline{X}^{DTD}(\ell) = \begin{cases} \gamma_{DTD} \cdot \overline{X}^{DTD}(\ell-1) + (1-\gamma_{DTD}), & \text{if } DTD(\ell) > 0, \\ \gamma_{DTD} \cdot \overline{X}^{DTD}(\ell-1), & \text{else.} \end{cases} \tag{24}$$

The detection of double-talk regions is followed by comparison with a threshold:

$$\widetilde{DTD}(\ell) = \begin{cases} 1, & \text{if } \overline{X}^{DTD}(\ell) > \Theta_{\widetilde{DTD}}, \\ 0, & \text{else.} \end{cases} \tag{25}$$

Figure 4:
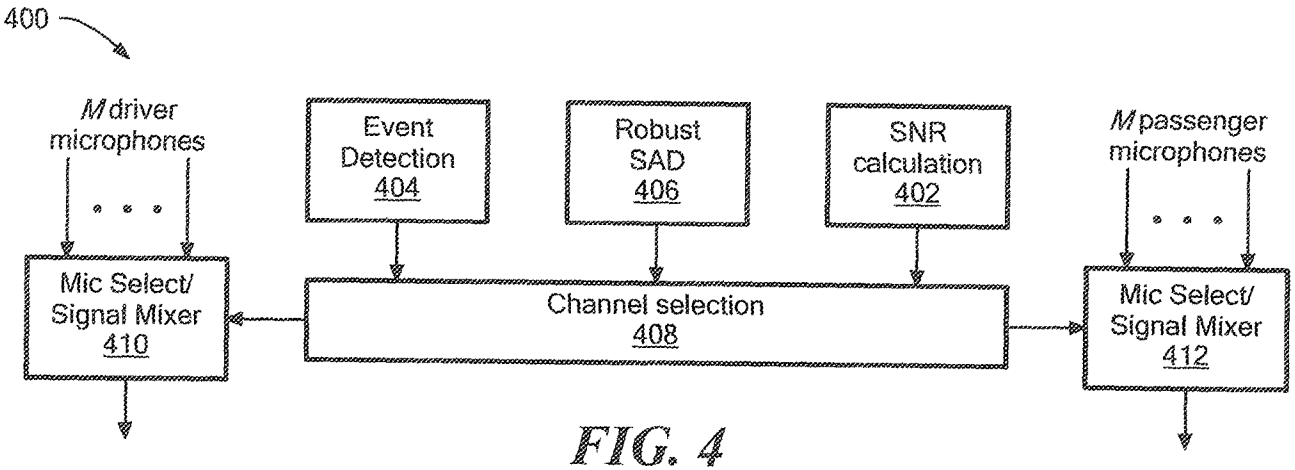
FIG. 4 is a schematic representation of an exemplary channel selection system using robust speaker activity detection.

FIG. 4 shows an exemplary microphone selection system 400 to select a microphone channel using information from a SNR module 402, an event detection module 404, which can be similar to the event detection module 304 of FIG. 3, and a robust SAD module 406, which can be similar to the robust SAD module 306 of FIG. 3, all of which are coupled to a channel selection module 408. A first microphone select/signal mixer 410, which receives input from M driver microphones, for example, is coupled to the channel selection module 408. Similarly, a second microphone select/signal mixer 412, which receives input from M passenger microphones, for example, is coupled to the channel selection module 408. As described more fully below, the channel selection module 408 selects the microphone channel prior to any signal enhancement processing. Alternatively, an intelligent signal mixer combines the input channels to an enhanced output signal. By selecting the microphone channel prior to signal enhancement, significant processing resources are saved in comparison with signal processing of all the microphone channels.

When a speaker is active, the SNR calculation module 402 can estimate SNRs for related microphones. The channel selection module 408 receives information from the event detection module 404, the robust SAD module 406 and the SNR module 402. If the event of local disturbances is detected locally on a single microphone, that microphone should be excluded from the selection. If there is no local distortion, the signal with the best SNR should be selected. In general, for this decision, the speaker should have been active.

In one embodiment, the two selected signals, one driver microphone and one passenger microphone can be passed to a further signal processing module (not shown), that can include noise suppression for hands free telephony of speech recognition, for example. Since not all channels need to be processed by the signal enhancement module, the amount of processing resources required is significantly reduced.

In one embodiment adapted for a convertible car with two passengers with in-car communication system, speech communication between driver and passenger is supported by picking up the speaker's voice over microphones on the seat belt or other structure, and playing the speaker's voice back over loudspeakers close to the other passenger. If a microphone is hidden or distorted, another microphone on the belt can be selected. For each of the driver and passenger, only the best microphone will be further processed.

Alternative embodiments can use a variety of ways to detect events and speaker activity in environments having multiple microphones per speaker. In one embodiment, signal powers/spectra $\Phi_{SS}$ can be compared pairwise, e.g., symmetric microphone arrangements for two speakers in a car with three microphones on each seat belts, for example. The top microphone m for the driver Dr can be compared to the top microphone of the passenger Pa, and similarly for the middle microphones and the lower microphones, as set forth below:

$$\Phi_{SS,Dr,m}(l,k) \quad \Phi_{SS,Pa,m}(l,k) \tag{26}$$

Events, such as wind noise or body noise, can be detected for each group of speaker-dedicated microphones individually. The speaker activity detection, however, uses both groups of microphones, excluding microphones that are distorted.

In one embodiment, a signal power ratio (SPR) for the microphones is used:

$$SPR_m(\ell, k) = \frac{\Phi_{SS,m}(\ell, k)}{\Phi_{SS,m'}(\ell, k)} \tag{27}$$

Equivalently, comparisons using a coupling factor K that maps the power of one microphone to the expected power of another microphone can be used, as set forth below:

$$\Phi_{SS,m}(l,k)\cdot K_{m,m'}(l,k) \quad \Phi_{SS,m'}(l,k) \tag{28}$$

The expected power can be used to detect wind noise, such as if the actual power exceeds the expected power considerably. For speech activity of the passengers, specific coupling factors can be observed and evaluated, such as the coupling factors K above. The power ratios of different microphones are coupled in case of a speaker, where this coupling is not given in case of local distortions, e.g. wind or scratch noise.

Figure 5:
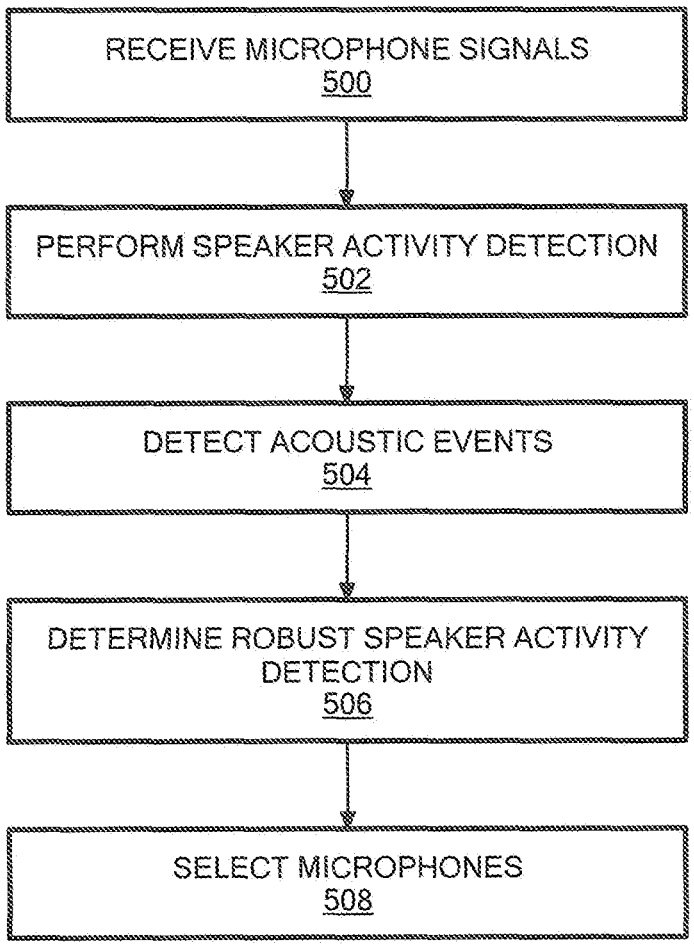
FIG. 5 is a flow diagram showing an exemplary sequence of steps for robust speaker activity detection.

FIG. 5 shows an exemplary sequence of steps for providing robust speaker activity detection in accordance with exemplary embodiments of the invention. In step 500, signals from a series of speaker-dedicated microphones are received. Preliminary speaker activity detection is performed in step 502 using an energy-based characteristic of the signals. In step 504, acoustic events are detected, such as local noise, wind noise, diffuse sound, and/or double-talk. In step 506, the preliminary speaker activity detection is evaluated against detected acoustic events to identify preliminary detections that are generated by acoustic events. Robust speaker activity detection is produced by removing detected acoustic events from the preliminary speaker activity detections. In step 508, microphone(s) can be selected for signal enhancement using the robust speaker activity detection, and optionally, signal SNR information.

Figure 6:
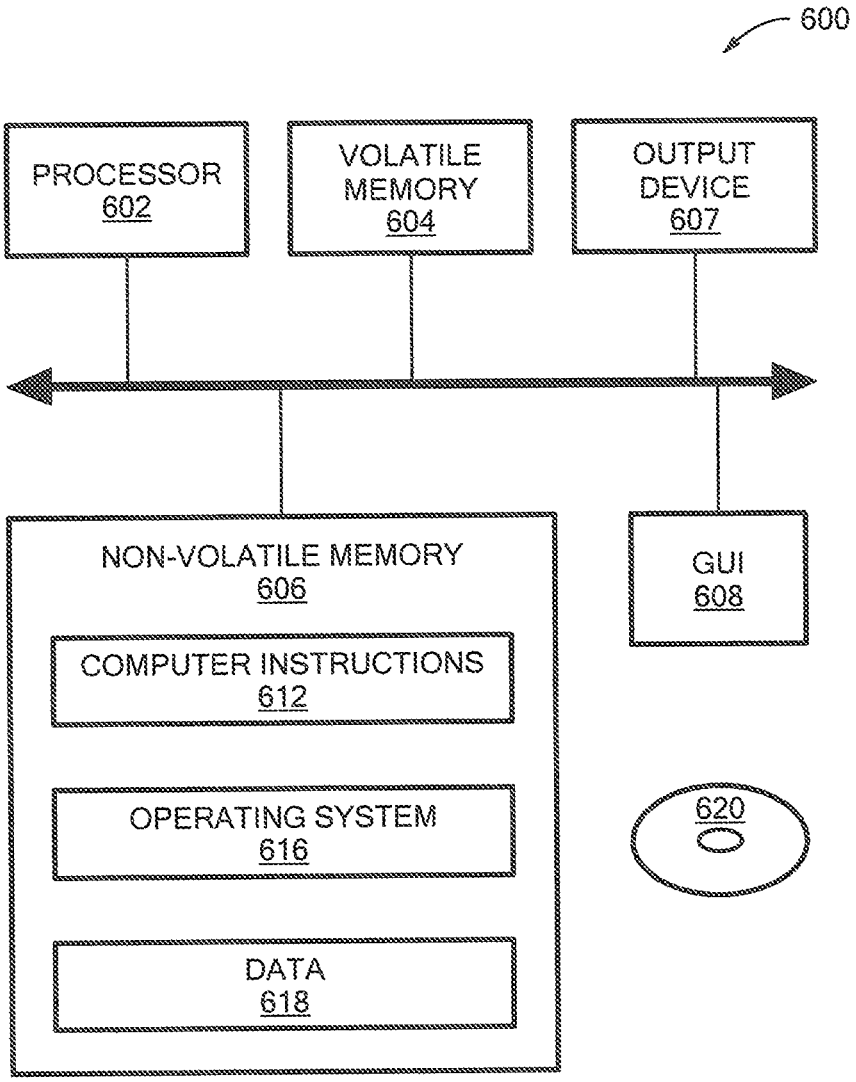
FIG. 6 is a schematic representation of an exemplary computer that performs at least a portion of the processing described herein.

FIG. 6 shows an exemplary computer 800 that can perform at least part of the processing described herein. The computer 800 includes a processor 802, a volatile memory 804, a non-volatile memory 806 (e.g., hard disk), an output device 807 and a graphical user interface (GUI) 808 (e.g., a mouse, a keyboard, a display, for example). The non-volatile memory 806 stores computer instructions 812, an operating system 816 and data 818. In one example, the computer instructions 812 are executed by the processor 802 out of volatile memory 804. In one embodiment, an article 820 comprises non-transitory computer-readable instructions.

Processing may be implemented in hardware, software, or a combination of the two. Processing may be implemented in computer programs executed on programmable computers/machines that each includes a processor, a storage medium or other article of manufacture that is readable by the processor (including volatile and non-volatile memory and/or storage elements), at least one input device, and one or more output devices. Program code may be applied to data entered using an input device to perform processing and to generate output information.

The system can perform processing, at least in part, via a computer program product, (e.g., in a machine-readable storage device), for execution by, or to control the operation of data processing apparatus (e.g., a programmable processor, a computer, or multiple computers). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment. A computer program may be deployed to be executed on one computer or on multiple computers at one site or distributed across multiple sites and interconnected by a communication network. A computer program may be stored on a storage medium or device (e.g., CD-ROM, hard disk, or magnetic diskette) that is readable by a general or special purpose programmable computer for configuring and operating the computer when the storage medium or device is read by the computer. Processing may also be implemented as a machine-readable storage medium, configured with a computer program, where upon execution, instructions in the computer program cause the computer to operate.

Processing may be performed by one or more programmable processors executing one or more computer programs to perform the functions of the system. All or part of the system may be implemented as, special purpose logic circuitry (e.g., an FPGA (field programmable gate array) and/or an ASIC (application-specific integrated circuit)).

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A method, comprising:

receiving signals from speaker-dedicated first and second microphones;

computing, using a computer processor, an energy-based characteristic of the signals for the first and second microphones;

determining a speaker activity detection measure from the energy-based characteristics of the signals for the first and second microphones;

detecting acoustic events using power spectra for the signals from the first and second microphones, wherein the acoustic events include double talk determined using a smoothed measure of speaker activity that is thresholded; and determining a robust speaker activity detection measure from the speaker activity measure and the detected acoustic events.

2. The method according to claim 1, wherein the signal from the speaker-dedicated first microphone includes signals from a plurality of microphones for a first speaker.

3. The method according 1, wherein the energy-based characteristics include one or more of power ratio, log power ratio, comparison of powers, and adjusting powers with coupling factors prior to comparison.

4. The method according to claim 1, further including providing the robust speaker activity detection measure to a speech enhancement module.

5. The method according to claim 1, further including using the robust speaker activity measure to control microphone selection.

6. The method according to claim 5, further including using only the selected microphone in signal speech enhancement.

7. The method according to claim 5, further including using SNR of the signals for the microphone selection.

8. The method according to claim 1, further including using the robust speaker detection activity measure to control a signal mixer.

9. The method according to claim 1, wherein the acoustic events include one or more of local noise, wind noise, diffuse sound, double-talk.

10. The method according to claim 1, excluding use of a signal from a first microphone based on detection of an event local to the first microphone.

11. The method according to claim 1, further including selecting a first signal of the signals from the first and second microphones based on SNR.

12. The method according to claim 1, further including receiving the signal from at least one microphone on a seat belt of a vehicle.

13. The method according to claim 1, further including performing a microphone signal pair-wise comparison of power or spectra.

14. The method according to claim 1, further including computing the energy-based characteristic of the signals for the first and second microphones by:

determining a speech signal power spectral density (PSD) for a plurality of microphone channels;

determining a logarithmic signal to power ratio (SPR) from the determined PSD for the plurality of microphones;

adjusting the logarithmic SPR for the plurality of microphones by using a first threshold;

determining a signal to noise ratio (SNR) for the plurality of microphone channels;

counting a number of times per sample quantity the adjusted logarithmic SPR is above and below a second threshold;

determining speaker activity detection (SAD) values for the plurality of microphone channels weighted by the SNR; and comparing the SAD values against a third threshold to select a first one of the plurality of microphone channels for the speaker.

15. A system, comprising:

a speaker activity detection means for detecting speech in a first speaker-dedicated microphone and/or a second speaker-dedicated microphone;

an acoustic event detection means for detecting acoustic events, wherein the acoustic event detection means is coupled to the speaker activity means, wherein the acoustic events include double talk determined using a smoothed measure of speaker activity that is thresholded, a robust speaker activity detection means for detecting speech based on information from the speaker activity detection means and the acoustic event detection means; and a speech enhancement means for enhancing a speech signal from the robust speaker activity detection means.

16. The system according to claim 15, further including a SNR means and a channel selection means coupled to the SNR means, the robust speaker identification means, and the event detection means.

17. An article, comprising:

a non-transitory computer readable medium having stored instructions that enable a machine to:

receive signals from speaker-dedicated first and second microphones;

compute an energy-based characteristic of the signals for the first and second microphones;

determine a speaker activity detection measure from the energy-based characteristics of the signals for the first and second microphones;

detect acoustic events using power spectra for the signals from the first and second microphones, wherein the acoustic events include double talk determined using a smoothed measure of speaker activity that is thresholded; and determine a robust speaker activity detection measure from the speaker activity measure and the detected acoustic events.

* * * * *